United States Patent [19]

Dodge et al.

[11] Patent Number: 4,502,778

[45] Date of Patent: Mar. 5, 1985

[54] SYSTEM FOR MONITORING AND CONTROLLING ELECTROPHOTOGRAPHIC TONER OPERATION

[75] Inventors: John H. Dodge, Thornton; Thomas F. Eichhorn, Boulder County; Peter A. Stevenson, Boulder, all of Colo.

[73] Assignee: International Business Machines Corporation, Armonk, N.Y.

[21] Appl. No.: 453,847

[22] Filed: Dec. 27, 1982

[51] Int. Cl.[3] ..... G03G 15/00

[52] U.S. Cl. ..... 355/14 E; 355/14 D; 355/14 R; 355/3 DD; 355/3 SH

[58] Field of Search ..... 355/3 DD, 3 SH, 3 BE, 355/3 CH, 3 TE, 3 TR, 3 R, 14 D, 14 E, 14 R, 15; 222/56

[56] References Cited

U.S. PATENT DOCUMENTS

| | | | |
|---|---|---|---|
| 3,647,293 | 3/1972 | Queener | 355/15 |
| 4,141,645 | 2/1979 | Reid et al. | 355/3 DD |
| 4,178,095 | 12/1979 | Champion et al. | 355/14 R |
| 4,179,213 | 12/1979 | Queener | 355/14 R |
| 4,183,657 | 1/1980 | Ernst et al. | 355/14 R |
| 4,279,498 | 7/1981 | Eda et al. | 355/14 D |
| 4,313,671 | 2/1982 | Kuru | 355/14 D |
| 4,316,667 | 2/1982 | Edwards et al. | 355/3 SH |
| 4,319,829 | 3/1982 | Janeway et al. | 355/3 BE |
| 4,326,646 | 4/1982 | Lavery et al. | 222/56 |
| 4,341,461 | 7/1982 | Fantozzi | 355/14 D |
| 4,348,099 | 9/1982 | Fantozzi | 355/14 E |
| 4,372,669 | 2/1983 | Fantuzzo et al. | 355/14 E X |
| 4,374,616 | 2/1983 | Sasaki et al. | 355/14 E X |
| 4,377,332 | 3/1983 | Tamura | 355/14 D X |
| 4,377,338 | 3/1983 | Ernst | 355/14 D |
| 4,378,158 | 3/1983 | Kanbe | 355/14 D X |

FOREIGN PATENT DOCUMENTS

| | | |
|---|---|---|
| 37731 | 10/1981 | European Pat. Off. . |
| 2915052 | 10/1979 | Fed. Rep. of Germany . |
| 2050649 | 1/1981 | United Kingdom . |

OTHER PUBLICATIONS

IBM Technical Disclosure Bulletin, vol. 19, No. 11, Apr. 1977, "Toner Concentration Control," by G. L. Smith, pp. 4078–4079.

IBM Technical Disclosure Bulletin, "Patch Sensor Ratio Control Enhancement Technique", by J. R. Champion et al., vol. 25, No. 3B, 8/82, pp. 1392–1393.

*Primary Examiner*—A. T. Grimley
*Assistant Examiner*—Terrance L. Flower
*Attorney, Agent, or Firm*—Earl C. Hancock

[57] ABSTRACT

Digital circuitry and microprocessor techniques are used to monitor the quality of toner operations in a copier and take appropriate corrective action based upon the monitoring results. Patch sensing is used. Reflectivity signals from the patch and from clean photoconductor are analog-to-digital converted and a plurality of these signals taken over discrete time periods of a sample are stored. The stored signals are averaged for use in determining appropriate toner replenishment responses and/or machine failure indicators and controls.

11 Claims, 11 Drawing Figures

SYSTEM FOR MONITORING AND CONTROLLING ELECTROPHOTOGRAPHIC TONER OPERATION

BACKGROUND OF THE INVENTION

1. Field of the invention

The present invention relates to apparatus and methods for monitoring the operation of xerographic or electrophotographic copiers or printers. More particularly, the present invention relates to methods and apparatus for determining that toner is appropriately applied to photoconductive material in a xerographic copier/-printer, and for providing appropriate responses to the results of such determinations. Still further, the present invention relates to the application of digital circuitry and data processing devices and processes for monitoring xerographic copier/printer operations relating to toner with appropriate control, or other responses to the results of such monitoring. The present invention is particularly useful for allowing maximum utilization of digital processes and devices in association with the operation and control of xerographic apparatus.

2. Description of the Prior Art

Electrophotographic printers and copiers appropriately discharge a previously charged photoconductor to produce an image that is transferred to a copy sheet or the like by means of toner received on the photoconductor from a developer. Acceptable quality for the final copy is a direct function of proper operation of the developer and the photoconductor itself. Degraded quality results from inadequate performance of the developer, charging elements, toner supply, photoconductor condition (i.e., aging, damage, etc ), and various other factors associated with the operation of the xerographic device. It was recognized early in the development of such machines that the light reflectance characteristics associated with the photoconductor and toned portions on that photoconductor correlate to proper operation of the machine elements.

Thus, one technique has developed in the prior art for monitoring xerographic machine operation by the process of applying a test patch of toner to the photoconductor with sensing of light reflectance from that patch for determining the amount of toner replenished into the developer. Analog circuitry for patch sensing and replenishment control is shown in U.S. Pat. No. 4,178,095 filed Apr. 10, 1978 by J. R. Champion and S. D. Seigal, as well as in the April 1977 IBM TECHNICAL DISCLOSURE BULLETIN at pages 4078–4079 in the article entitled "Toner Concentration Control" by G. L. Smith. Conversion of the analog signal produced from monitoring a test patch into digital signals for control by a computer in a xerographic machine is also well known in the prior art. Such systems generally monitor other factors such as the toner in the developer sump as well as continuous test patch monitoring until an appropriate result is produced.

An example of digital circuitry interfacing between the analog patch sensor photodetector system and a controlling computer is shown in FIG. 4 of U.S. patent application Ser. No. 291,136 filed Aug. 7, 1981 by L. M. Ernst, now U.S. Pat. No. 4,337,338.

A typical prior art approach is to perform light reflectivity sampling against both a clean photoconductor and a toned patch on the photoconductor, with the patch either in the normal image area or in the photoconductor area outside of the image area A test sample of clean and toned patches are initially performed and the results stored for comparison against later such test results. Differences from the standard and later test results are used to control the rate of toner replenishment into the developer from a reservoir. The rate of replenishment is increased if the toned patch reflectance test result shows a light test patch, while the rate is decreased if excessively dark test patches are obtained. Other electrophotographic process adjustments are available in response to the toned test patch result such as variations in illumination level, adjustments to biasing for the developer and/or coronas and the like, as well as variations in replenisher rate.

Unfortunately, the results of a particular toned patch reflectance test do not necessarily indicate the operating condition of the electrophotographic components or the condition of the photoconductor itself. Where a photodetector result is analog-to-digital converted, the resulting digital signal actually indicates the level of a small area sample rather than an indication of the overall quality of the complete patch. Accordingly, any aberration associated with the sample increment can produce corrective efforts on the part of the controlling computer which are inappropriate for the average condition of the machine and photoconductor. The present invention overcomes the shortcomings of the prior art by advantageously utilizing digital circuitry and controlling computers to ensure accuracy of toner level sampling as well as to allow corrective action by the controlling computers or microprocessors, as appropriate.

DISCLOSURE OF THE INVENTION

This invention relates to a xerographic copier or printer which has a sensor for producing an output signal indicative of the reflectivity of the photoconductor along with means for establishing a test patch on that photoconductor. In accordance with the invention, the sensor output is sampled a plurality of discrete times as the test patch moves past the sensor. Signals indicative of the result of the discrete samples are stored and averaged for producing a signal representative of the overall reflectivity of the patch. Thus, this average signal is useful for determining the quality of copier/-printer operation. The test patch is either clean photoconductor or has toner applied thereto. By performing the multiple discrete sampling of clear photoconductor and an additional set based upon the toned test patch, the sets of averaged data are comparable to establish a standard or to allow comparison against the previously-stored standard reflectivity difference relative to the toned and untoned test patches. This allows adjustment of the rate of toner replenishment in the developer for the copier in accordance with the comparison result along with other appropriate machine control responses.

Another feature of the present invention is that the test patch results which are producing out-of-tolerance differences for a predetermined number of occasions allow the system to ensure that an uncorrectable situation has resulted before instituting appropriate action such as lighting a display to notify the operator that machine attention is required, causing cessation of machine operation, or the like.

Still another feature of this invention relates to the use of digital circuits and one or more digital data processing units for acquiring and processing data with regard to the reflectance of toned and untoned test patches on the photoconductor of an electrophotographic machine.

The invention is applicable to a copier which has a housing overlying the scanning window to permit original document sheet feeds but with the housing movable between a closed position and an open position to permit copying of books or other non-feedable objects and wherein a closed housing position is necessary to perform a photoconductor reflectivity test. In such a copier, the invention includes means for preventing the photoconductor patch testing except when the housing is closed.

Yet another feature of the present invention is the interconnection and arrangement of multiple data processing units such as microprocessors for division of control of the electrophotographic elements and of information receiving and transmitting interface elements with a cooperative interchange between those data processing units. More particularly, at least one of the data processing units controls the electrophotographic elements including acquisition of data from those elements while another data processing unit generates commands to the first unit and receives the data acquired from the first unit to determine if the copier performance meets predetermined standards.

The present invention is particularly advantageous in that normal xerographic copier or printer processing is not interrupted to acquire the test patch data because the test is performed during the run-out phase of machine operation. The results are stored and averaged over a relatively long period. While the test may involve extension of the run-out phase under some circumstances depending in part on machine configuration, such an extension is essentially transparent to the user.

Those having normal skill in the art will readily recognize the foregoing and other objects, features, advantages and applications of the present invention in light of the following more detailed description of the exemplary preferred embodiment as illustrated in the accompanying drawings.

DETAILED DESCRIPTION OF THE PREFERRED EMBODIMENT

Figure 1:
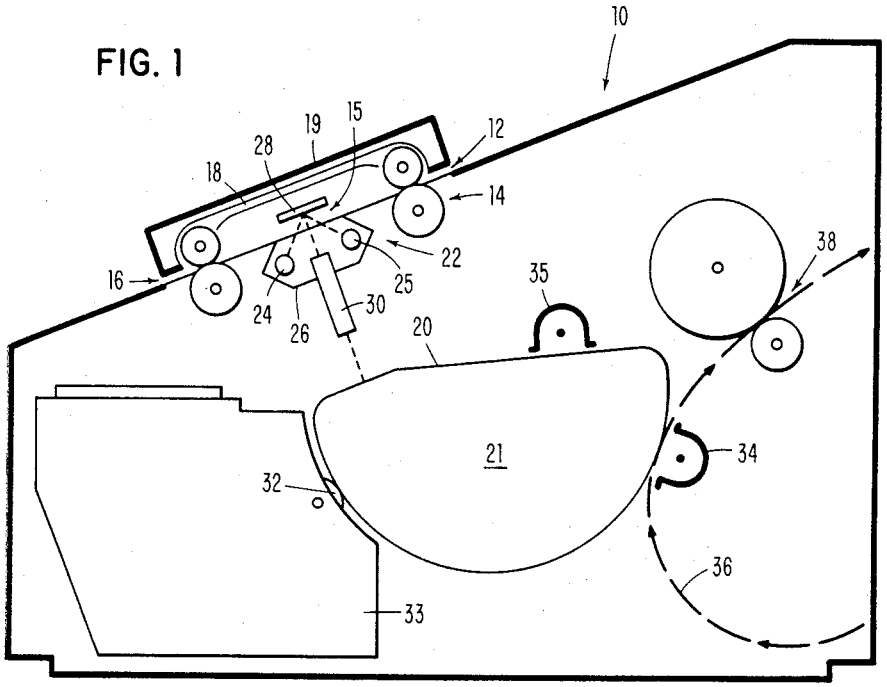
FIG. 1 is a side view of a copier in somewhat schematic form, and which is suitable for use in conjunction with the present invention.

The preferred embodiment is shown and illustrated in exemplary form relative to a two-cycle copier 10. The basic two-cycle copier concept is taught in U.S. Pat. No. 3,647,293 filed Dec. 1, 1970 by C. A. Queener. In the preferred embodiment example of this application, the system of the present invention is described relative to controls for density of toner on the copier photoconductor and, more particularly, relative to controlling the toner replenishment feed rate of the developer based on tests of the reflectance of the toner on the photoconductor.

In copier 10, original documents for copying are inserted at input 12 and driven by an array of rollers 14 past an optical scan window shown generally at 15, and either exit at output 16 or are recirculated around recirculating automatic document feed (RADF) path shown generally at 18.

A belt-type photoconductor 20 is continuously driven counterclockwise around a mounting capstan 21 configured and operated in a manner similar to that shown in U.S. Pat. No. 4,319,829 filed July 30, 1980 by D. L. Janeway and P. A. Stevenson. The recirculating document feed 18 in housing 19 can take any of several configurations such as that shown in U.S. Pat. No. 4,316,667 filed Feb. 19, 1980 by E. G. Edwards, J. T. Robinson and B. O. Wilzbach as well as that shown in the aforementioned U.S. Pat. No. 4,319,829.

The optical system of copier 10 includes illumination lamps 24 and 25 contained within reflective housing 26 to direct light either against the original as it passes scan window 15 or against a reflective surface 28 to cause light to pass through conventional fiber optic bundle 30 onto the photoconductor. Lamps 24 and 25 are selectively controlled in on and off modes to produce an electrophotographic image on photoconductor 20 or to discharge photoconductor 20, depending upon the cycle of the machine.

In the two-cycle process as shown, corona 34 initially operates as a charge corona to place an appropriate electrostatic voltage level on photoconductor belt 20. While corona 35 is off during the exemplary charging operation as described, it can perform a precharge function, if desired. The image of an original document passing scan window 15 is placed upon belt 20 by selective discharge based upon the image contained in the original as is conventional. The image is developed by developer unit 33 which places toner on appropriate areas of belt 20 as it passes magnetic brush roller 32. Copy sheets are appropriately fed through path 36 to receive the image from photoconductor 20 as the sheets pass under corona 34 which is then acting as a transfer corona. The image of toner from the photoconductor which is transferred to the copy sheet is fused on the copy sheets as they pass through heated fuser rolls 38 and thence the copy sheet exits the machine.

Developer 33 acts as a cleaning station on the cycle following the transfer of an image to the copy sheet at copy sheet path 36. Also during the cleaning cycle, corona 35 is switched on, as are lamps 24 and 25, to discharge photoconductor 20. These results are obtained by appropriate timing control as is well known.

Figure 2:
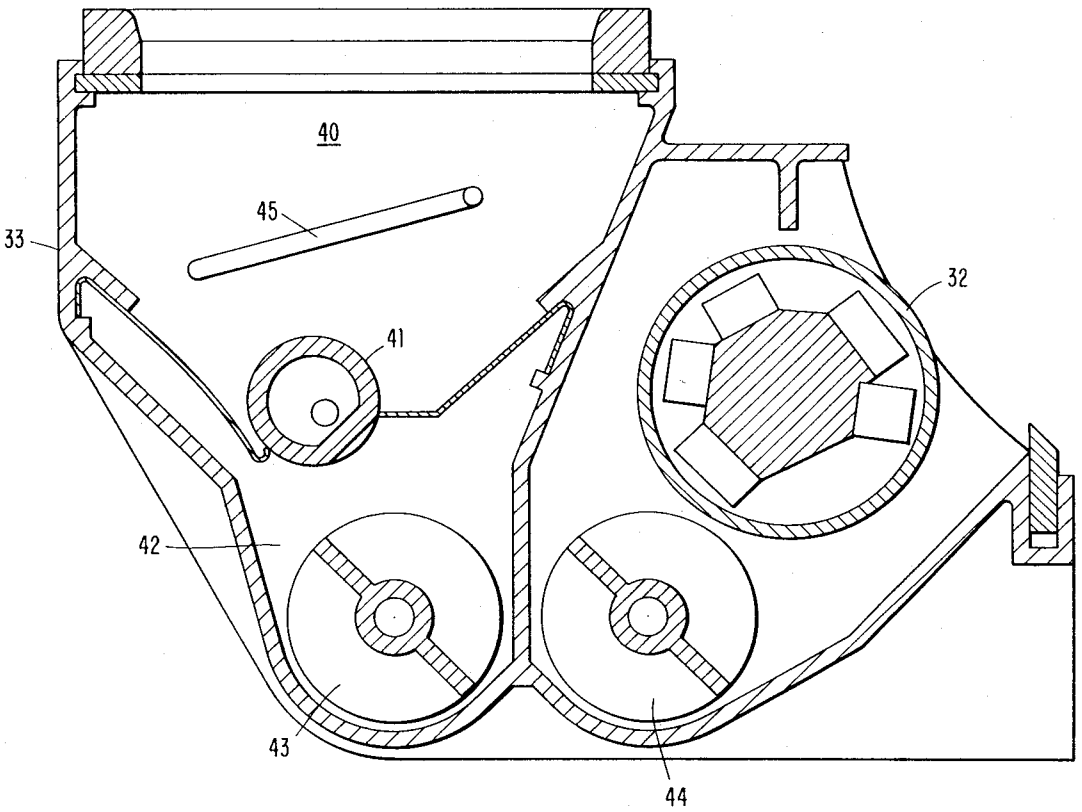
FIG. 2 is a section view of a typical developer including toner replenishment reservoir and metering structure.

FIG. 2 is a sectioned view of developer 33 showing a toner replenisher reservoir 40 which is loaded with toner and which feeds toner past metering roller 41 into the sump 42 of developer 33. Dual augers 43 and 44 continuously recirculate the developer mix in the sump and transfer it to magnetic brush roll 32 for application to the image on photoconductor 20. A pivotable bar 45 contained within reservoir 40 is oscillated periodically and rests upon the upper level of the toner in sump 40 to indicate whenever the level has dropped below a predetermined point. Metering roll 41 is typically coupled to a selectively actuated clutch, such as a one-revolution clutch, to provide the toner metering function in a well known manner in response to control signals.

Figure 3:
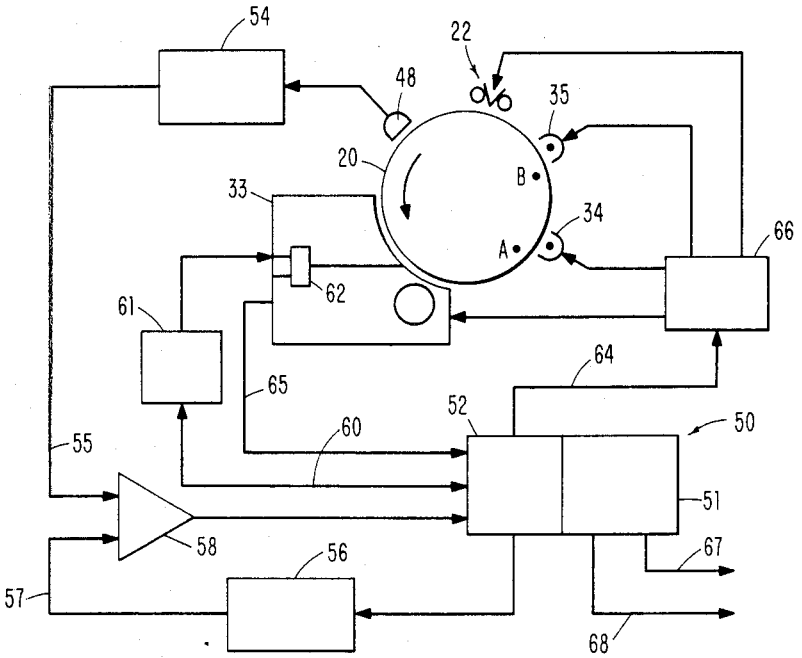
FIG. 3 is a diagram illustrating the interrelationship of the control and monitoring circuitry with the operating components of a copier.

FIG. 3 is a block diagram showing various elements correlated to FIGS. 1 and 2 copier apparatus interrelated with controlling electronics in accordance with the present invention particularly as adapted for use in a toner replenishment control system. Photoconductor 20 is shown in a circular configuration rotating counterclockwise in FIG. 3 as well as in FIGS. 5 and 6 for simplicity purposes, although this further illustrates that the photoconductor 20 can assume a belt or drum configuration. The system shown in FIG. 3 maintains a constant reflectance (the reciprocal of optical density) of developed toner on photoconductor 20 by adjusting the rate of toner replenishment feeds in developer 33. Samples of reflectance are taken using an optical transducer or sensor 48 which is a light source and photodetector type of arrangement. Infrared or visible light are suitable for the sensor 48 function as long as the light source and photodetector are appropriately compatible. A microcomputer system 50, including a master microcomputer 51 and a slave microcomputer 52, analyzes the samples and adjusts the replenishment rate to developer 33.

Figure 4:
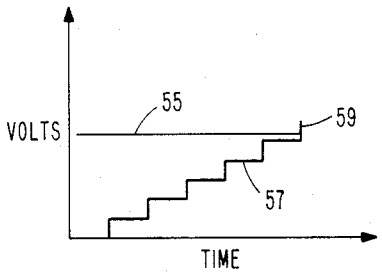
FIG. 4 is a time-based diagram illustrating a typical comparison of a photosensor output and a digitally generated varying reference level.

The output of sensor 48 is amplified in amplifier 54 and provides one input 55 to comparator 58. Slave microcomputer 52 provides a series of signals to digital-to-analog converter 56 which introduces the second input 57 to comparator 58. The inputs in a typical operating example for comparator 58 are shown in FIG. 4. That is, the output of digital-to-analog converter 56 at 57 increases in a staircase mode until it surpasses the level of the sensor feedback 55. Thus, transition 59 of comparator 58 output represents a binary transition provided as an input to the slave microprocessor 52 to indicate the level of reflectance sensed by sensor 48.

Slave microcomputer 52 receives and transmits signals over multiple connector 60 into driver circuit 61. Thus, at suitable times, a signal is produced on line 60 energizing driver circuit 61 which, in turn, energizes solenoid 62 to cause the metering roll 41 in developer 33 to discharge a portion of toner into the sump 42 of developer 33 (note FIG. 2). The state of the switch associated with pivoting sensor arm 45 shown in FIG. 2 produces an input over line 65 to slave microprocessor 52 thereby indicating whether the level of toner in reservoir 40 of developer 33 is adequate. Slave microprocessor 52 also produces output signals over line 64 to appropriately switch various power supplies 66 so as to provide biasing levels for developer 33, coronas 34 and 35 and illumination assembly 22. Master microcomputer 51 produces output signals at 67 to control the original document feeder and signals over multiple output line 68 to provide appropriate displays on an operator control panel (not shown). Microcomputers 51 and 52 are appropriately interconnected for providing information exchanges as is apparent from the subsequent description.

Figure 7:
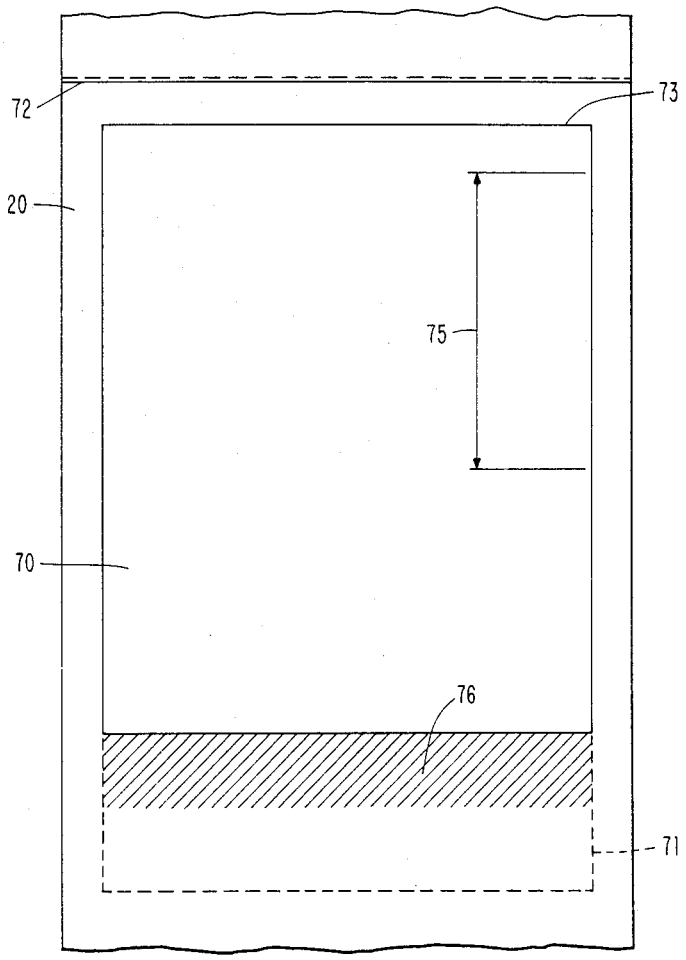
FIG. 7 is a segment of a typical photoconductor showing the position of the toned and untoned sample areas.

Prior to each reflective sample, the system is calibrated under control of slave microcomputer 52. This minimizes problems of component drift, optical transducer or sensor 48 contamination and reflectance changes of photoconductor 20. Reflectance samples, in accordance with this invention, consist of five tests averaged by the microcomputer system 50. This rejects photoconductor effects as from pin holes, scratches or the like, and inconsistencies in the developed areas. As shown in FIG. 7, the reflectance sample or patch is made in a normally used area 70 of photoconductor 20, particularly when taken in conjunction with the normal longer document additional area represented by dotted area 71. In this particular configuration, a belt or drum seal is shown at 72 and, in conjunction with timer devices or circuitry associated with the normal machine operation, correlates the leading edge 73 of the normal image area in typical usage.

By performing the sample tests in the normally used areas 70 and 71 of photoconductor 20, more realistic data is developed relative to the actual performance of copier 10. Further, the throughput of copier 10 is not affected as the toner test is only performed when copier 10 has completed a copy job. This is accomplished by coordinating the test sampling with the original document feed of copier 10. Note that microcomputer system 50 can indicate failures in the system such as inability to test due to failure in the sensing system itself, and the failure of the toner system to respond to controls.

When a toner test is required, microcomputer system 50 operates in accordance with the following sequence. At the beginning of the photoconductor 20 image area 70, coronas 34 and 35 begin cleaning the photoconductor 20 as is generally shown in FIG. 3 where point "A" indicates the beginning of the image area and point "B" the area of the toned patch 76.

While the coronas are discharging photoconductor 20, a similar function is performed by illumination system 22. In this phase, developer 33 cleans residual toner from photoconductor 20.

As point "A" passes sensor 48, microcomputer system 50 begins a sequence to obtain reference reflectance data for clean photoconductor 20 by sampling in the area generally indicated at 75 in FIG. 7. Light from a LED source or the like is reflected from photoconductor 20 in area 75 and collected by a photodetector in sensor 48. This reflectance signal is amplified at 54 and compared to a staircase level illustrated in FIG. 4 as generated by slave microcomputer 52 through D/A converter 56 in FIGURE 3. Four samples of clean photoconductor 20 in the area 75 are taken and averaged by slave microcomputer 52 to determine the clean photoconductor reference.

Figure 8A:
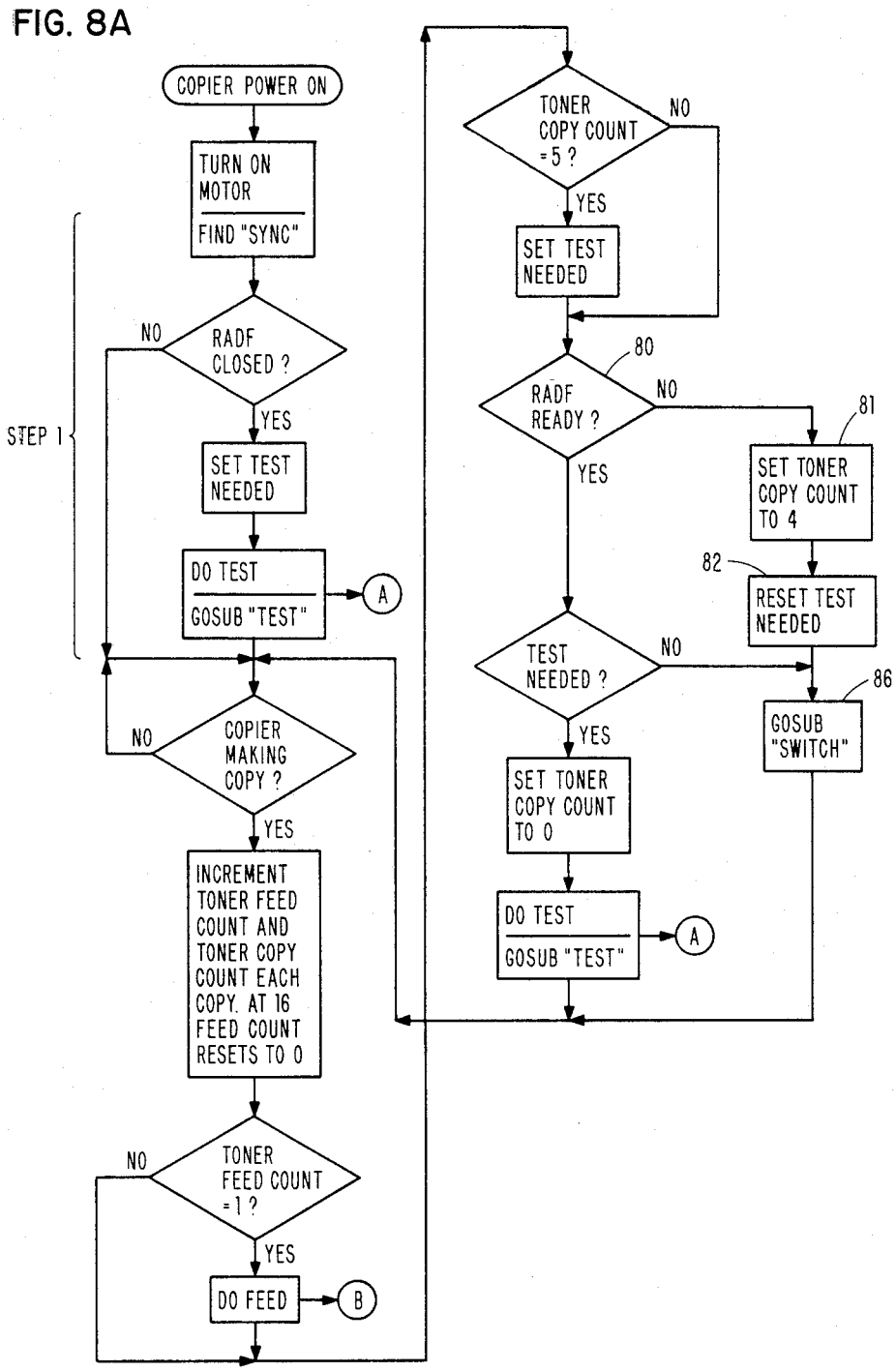
FIGS. 8A–8C are flowcharts of the operation of the master microprocessor in the present invention.
Figure 8B:
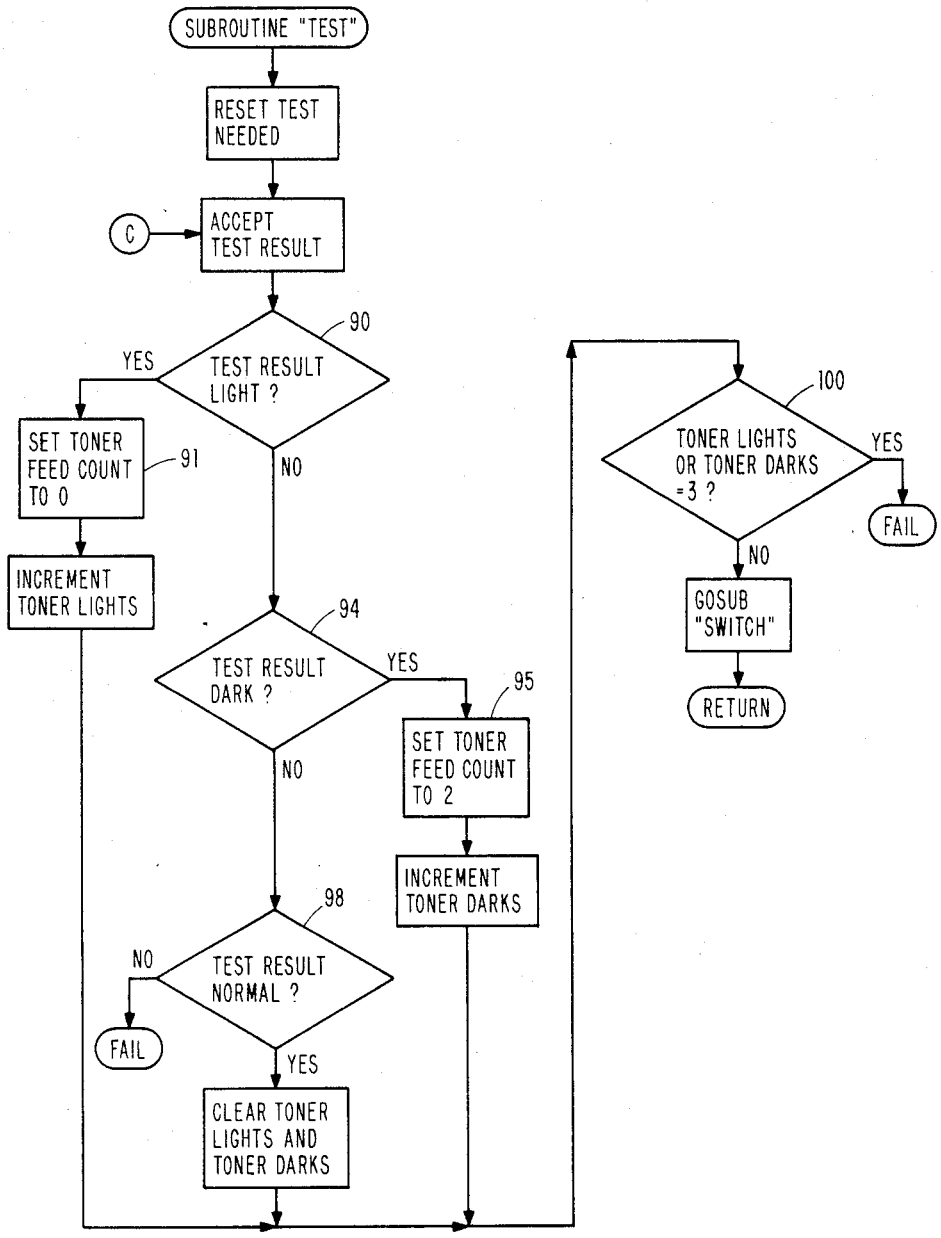
Figure 8C:
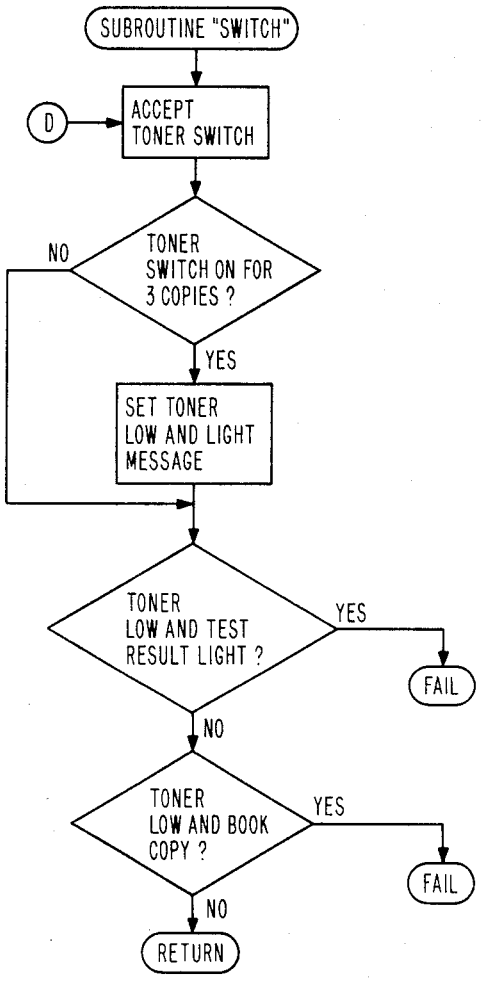
Figure 9:
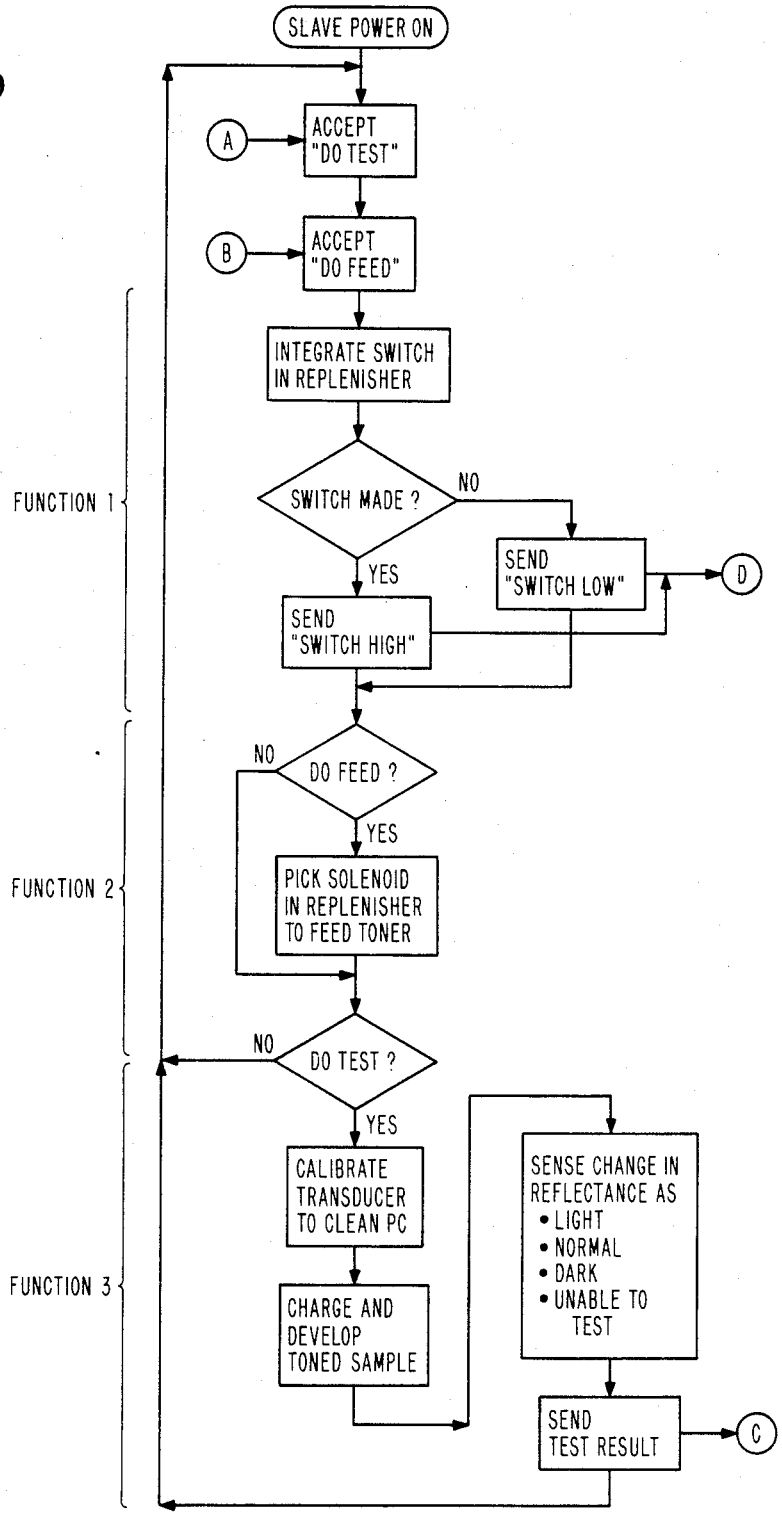
FIG. 9 is a flowchart of the slave microprocessor operation.

The steps followed by microcomputers 51 and 52 are shown in the flowcharts of FIGS. 8 and 9, respectively. These two microcomputers implement a control sequence tailored to the anticipated usage of copier 10. FIGS. 8 and 9 show logical steps microcomputers 51 and 52 go through to control when a toner test is possible (based upon the number of copies since the last test and appropriate placement of the document feed housing 19), when to feed toner by picking replenisher solenoid 62, when a message of low toner in the replenisher is indicated over input 65 based on the history of the toner low switch, how the toner test is performed (calibrating the optical transducer to clean photoconductor, developing a toned sample 76 and sensing the change in reflectance), how failures in the toner control system are detected, and how displays are activated on an operator control panel using line 68.

FIGS. 8A, 8B and 8C describe the logical operations of master computer 51. FIG. 9 describes slave computer 52 in terms of this toner control system. The following are definitions of the terms used:

BOOK COPY: A test bit in master 51 that indicates copying with the document feeder 19 raised.

RADF CLOSED: Is document feeder 19 closed to position reflective surface 28 for cleaning photoconductor 20?

RADF READY: Signals that reflective surface 28 is down and that no originals are in path 18.

TEST NEEDED: A test bit in master 51 is used to determine if slave 52 should perform a toner test.

TEST RESULT: Result of toner test sent from slave to master.

TONER COPY COUNT: Another four-bit counter that is incremented for each copy made. When its count equals five, a test bit (TEST NEEDED) is set. A toner test occurs after five copies.

TONER FEED COUNT: A counter is incremented each copy (counts 0 to 15 and wraps around to 0; a four-bit counter). When count equals 1, master 51 tells slave 52 to feed toner.

TONER DARKS: A counter in master 51 that counts reports from slave 52 of dark patch results.

TONER LIGHTS: A counter in master 51 that counts reports from slave 52 of light patch results.

TONER LOW: A test bit in master 51 that indicates slave 52 found the switch connected to pivotable bar 45 in developer 33 in a low position in the toner reservoir 40.

With regard to the slave operation pursuant to FIG. 9, slave 52 accepts commands from master 51. The first command is message (A), DO TEST, which is a command to perform a toner test. Another command is message (B), DO FEED, which is a command to feed toner into the developer 33.

Slave 52 does three main functions, namely:

(1) Observe the position of pivotable bar 45 in developer 33. This indicates the amount of toner in reservoir 40. Slave 52 reports to master 51 on the state of this switch as message (D).

(2) Feeds toner if so ordered by master 51 in reply to DO FEED message (B).

(3) Performs toner test if so ordered by master 51. Sends TEST RESULT to master as message (D).

The logical steps for these functions are not fully flowcharted. However, descriptions of these functions are found elsewhere in the text of this application.

The following is an explanatory listing of the connectors employed in FIGS. 8A–8C for master 51 with parenthesis around the connectors shown in circles in the drawings:

(A) message: Master to slave—DO TEST (B) message: Master to slave—DO FEED (C) message: Slave to master—TEST RESULT (D) message: Slave to master—SWITCH STATE RETURN: A return from subroutine GOSUB "TEST": Go to subroutine TEST GOSUB "SWITCH": Go to subroutine SWITCH FAIL: Master executes copier failure routine and sends indication of condition to operator control panel (not described).

When copier 10 is turned on, master 51 begins the initialization routine ("Step 1" in FIG. 8A). Part of this routine is starting the main drive motor and positioning the photoconductor 20 with respect to the coronas by placing the seam of the PC seal at a known location. This is "Finding SYNC." If the housing 19 for the document feeder 14 or RADF 18 is closed so that reflective surface 28 is above the photoconductor, the master 51 will order the slave 52 to do a toner test by sending a DO TEST message. The subroutine TEST is then executed. This step 1 (see FIG. 8A) initializes the toner system in the copier. The rest of FIG. 8A describes the bookkeeping the master does in order to control when a toner feed should occur (TONER FEED COUNT=1), when a toner test should occur (after TONER COPY COUNT=5) and when a test can occur (only with RADF READY).

Note that a feature of this invention is forcing a test after copier 10 operation in the Book Copy mode. Forcing a toner test after a Book Copy protects the copier from loss of toner. Copier 10 in the Book Copy mode does not have mirror 28 in place since housing 19 is raised and thus no erase function is available from illumination 22. More toner is usually demanded from the system as a result of the boundary areas of the book or object copied. Thus, when the RADF READY decision block 80 has a negative output, the TONER COPY COUNT is automatically set to four at 81 and TEST NEEDED is reset at 82 where they remain until housing 19 is again closed. The subroutine SWITCH is also called at 86 to determine the amount of toner in reservoir 40 of developer 33.

FIGS. 8B and 8C contain two subroutines, TEST and SWITCH, respectively. TEST of FIG. 8B is the subroutine that receives the test result, message (C), from the slave 52. The master 51 determines when a toner feed should occur by changing the value of TONER FEED COUNT. A toner feed count occurs when TONER FEED COUNT equals one. If the test result is light, the counter is set to zero and a feed will occur on the next copy. This is shown as response 91 to a positive light test result decision 90. Conversely, if the test result is dark at 94, the counter is set to two at block 95 and a feed is delayed as the counter counts to 15 and wraps around. Finally, if the test result is not light, not dark and not normal, decision block 98 indicates there is a failure.

The test at decision block 100 on TONER LIGHTS or TONER DARKS equalling 3 is a test to see if the system is oscillating between the extremes without an intervening normal test result. Note that a normal test result clears both counters.

The FIG. 8C subroutine SWITCH in master 51 accepts the state of the reservoir switch from the slave, message (D). If the switch is low for three consecutive times, the test bit TONER LOW is set and the indicator "Add Toner" is lit on the operator control panel. Two tests are then made. If TONER LOW is set and the toner test result is light, the copier is stopped (i.e., go to FAIL). The system needs more toner (toner result is light) but there is no more toner.

As mentioned previously, use of copier 10 in the Book Copy mode prevents performance of a toner test as there is no mirror 28 in place to clean photoconductor 20. A fail-safe feature of this invention is stopping the copier (i.e., go to FAIL) if TONER LOW is set and a toner test cannot occur.

FIG. 4 shows sample signals as slave microcomputer 52 initializes or calibrates to the clean photoconductor 20, section 75. Slave 52 outputs a bit pattern on multiple digital output lines to the D/A converter 56 for the lowest comparison level. These levels are incremented by changing the bit pattern such as a change every 8.3 milliseconds to increase the staircase voltage 0.25 volts. Once sensor 48 feedback 55 is less than the comparison level, comparator 58 switches and slave 52 stores the digital-to-analog level and begins another staircase sequence. This is repeated for a total of four times. The slave averages these D/A levels to determine the clean photoconductor 75 level that initializes the system.

Figure 5:
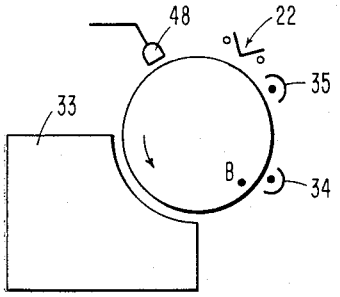
FIG. 5 is an illustration of the patch sensor position associated with the copier components at one point in time.
Figure 6:
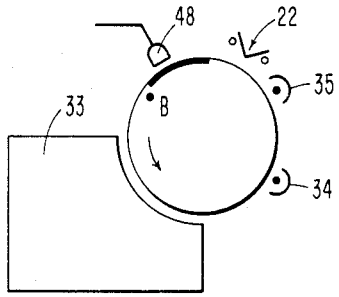
FIG. 6 is an illustration of the relationship of the copier components during toned patch sensing.

As the test sequence continues, point "B" arrives at corona 34 as shown in FIG. 5. Slave 52 switches corona 34 to charge a band or patch 76 on photoconductor 20. Corona 35 and illumination 22 are switched as point "B" passes so as not to erase patch 76. Developer 33 is switched as point "B" arrives to transfer from its clean bias level to its develop bias level to develop toned patch 76. The patch at point "B" has now completed a revolution and ultimately arrives beneath sensor 48 as shown in FIG. 6. Microprocessor 52 takes samples of reflectance of the toned patch 76 using the amplifier 54, digital-to-analog converter 56 and comparator 58 as described earlier for the clean photoconductor patch 75. Slave 52 can now determine the difference between the reflectance of clean patch 75 and toned patch 76 to make a judgment on the density of toner on the photoconductor. This reflectance decision level is based upon essentially an upper dark threshold and a lower light threshold with the patch difference exceeding the upper level indicating an excessively dark patch, below the lower light level indicating an excessively light patch, whereas anything in between indicates a normal or acceptable patch.

Slave microprocessor 52 reports the results of each toner test sequence to master microprocessor 51. These can indicate that no test was performed because the photoconductor 20 was too light to initialize, a light patch result was obtained, a normal patch result was obtained, a dark patch result was obtained, or no test was performed because the photoconductor 20 was too dark to initialize. Based on this information, master microcomputer 51 determines when toner replenishment feeds are needed, when the next toner test is needed and if the system is operating correctly. For example, a normal toner feed rate might indicate one feed of 400 milligrams of toner for every 16 copies made. The feed rate compensates for a light patch by shifting two feeds four copies apart every feed cycle, where a feed cycle is the time between toner tests such as ten copies. No toner feeds occur if the patch is dark. Master 51 can signal a system failure if a normal toner test result does not occur. Each type of test result from slave 52 is counted by master 51. If this count reaches a predetermined level, master 51 signals a failure. For instance, master 51 can terminate copier 10 operations and direct illumination of a "Call Key Operator" display over one of output lines 68.

Note that copier 10 with its recirculating document feeder 18 for originals is not interrupted in normal operation to accommodate the toner density samples which are taken without trapping any original document. Information obtained from a switch associated with level sensor arm 45 in the toner replenisher reservoir 40 and a toner patch sensor 48 is used to control an "Add Toner" display over output line 68 with this display flashing for an initial period and then continuously illuminated after the corrective action by the user has not resulted. After repowering copier 10, a sequence is initiated that develops and senses a set of test patches to establish initial feed conditions. Even though the toner reservoir level detector indicates low toner, a successful toner patch sample that is not excessively light results in a decision to allow the copier to continue to operate but to indicate the "Toner Low" display to the user.

In the system thus described, the myriad of tasks associated with operating copier 10 are divided and assigned between two separate data processing units composed of master and slave microprocessors 51 and 52. Master microprocessor 51 provides the input/output interface with the user, directs microprocessor 52 to perform various functions in general and the patch test sampling in particular, accepts data from microprocessor 52, renders logical decisions on the data collected, and initiates various responses and control signals such as for control of the main drive motor, as well as the original document and copy sheet feeds. Slave microprocessor 52 is arranged to respond to command signals from master microprocessor 51 especially to control the various electrophotographic processing elements including developer 33, coronas 34 and 35, illumination 22, metering roll 41, and sensor 48. In the operating example previously described, master computer 51 generates a signal to slave computer 52 to generate the test patch data. Slave computer 52 then independently acquires the patch data and either passes it on directly to computer 51 or averages the data before passing it to computer 51. Master 51 decides when it is appropriate to actuate replenisher metering roller 41 and instructs slave 52 to do so. By division of responsibilities along these lines, it is possible to concurrently handle routine internal machine controls and real time responses to the user as well as to the necessary decision-making process. The use of relatively low cost microprocessors also allows avoidance of a more expensive but larger single controlling computer.

Although the present invention is described herein with particularity relative to the foregoing detailed description of an exemplary embodiment, various modifications, changes, additions, and applications of the present invention in addition to those mentioned herein will readily suggest themselves to those having normal skill in the art without departing from the spirit of this invention.

What is claimed is:

1. In a copier having a sensor for producing an output signal indicative of the reflectivity of the photoconductor thereof and means for establishing a test patch on the photoconductor, an improved method comprising the steps of:

sampling the output of said sensor a plurality of discrete times as said patch moves past said sensor;

storing signals indicative of the result of each of the discrete samples; and averaging the stored signals for producing a signal representative of the reflectivity of said patch, whereby the average signal is usable for determining the quality of operation of the copier.

2. An improved method in accordance with claim 1 which includes the step of applying toner to said test patch prior to said sampling step.

3. An improved method in accordance with claim 1 which includes the further steps of:

applying toner to a test patch; and repeating said sampling, storing and averaging steps relative to said toned test patch whereby the two resultant average signals represent the reflectivity difference between untoned and toned photoconductor test patches.

4. An improved method in accordance with claim 3 which includes the further steps of:

comparing the reflectivity difference between the untoned and toned test patch average signals with at least one predetermined difference level; and adjusting the rate of toner replenishment in the developer of said copier in accordance with the result of said comparing step.

5. An improved method in accordance with claim 4 which includes the further steps of:

determining that a predetermined number of said adjusting steps has occurred with common results from said comparing step; and indicating said copier requires attention in response to said determining step.

6. In an electrophotographic machine having a plurality of electrophotographic processing elements arranged relative to a moving photoconductor with said elements including a developer, photoconductor charging and discharging devices and a sensor for producing a signal indicative of the reflectance of said photoconductor as said photoconductor moves past said sensor, and means for establishing patches on said photoconductor, the improvement comprising:

a digital-to-analog signal converter;

a comparator circuit receiving the reflectance sensor signal as a first input signal thereto and receiving the output of said converter as a second input signal thereto for providing a binary signal as an output to indicate the results of the comparison of said first and second input signals; and a digital data processing unit for providing the input to said converter and having an input receiving said comparator circuit binary signal output, said data processing unit including:

(i) means for producing a plurality of operations of said comparator circuit as each patch on the photoconductor passes the sensor;

(ii) means for storing the results of said plurality of comparator circuit operations; and (iii) means averaging said stored results for producing output signals.

7. An improved electrophotographic machine in accordance with claim 6 which further includes a second digital data processing unit including:

means for generating signals directing said first mentioned digital data processing unit to perform a sequence of said comparator circuit operations;

means for receiving said averaging means output signals; and means responsive to differences of said received average signals relative to predetermined standards for initiating corrective action by the electrophotographic machine.

8. An improved machine in accordance with claim 7 wherein said corrective action initiating means includes means for causing a change in the rate of toner replenishment to the developer element.

9. In an electrophotographic copier having a movable photoconductor and an original document scanning window with a housing movable into and out of overlying relationship with said window wherein said housing contains means cooperating with said copier for erasing said photoconductor when said housing is in said window overlying relationship, an improvement comprising:

means selectively operable for acquiring data on the reflectivity of at least one test patch on said photoconductor;

means sensing the relationship of said housing relative to said window; and means responsive to said sensing means for disabling said data acquiring means except when said housing is in said window overlying relationship.

10. A copier in accordance with claim 9 which includes means sensing the level of toner material available for feeding from a reservoir into a developer, said improvement further comprising:

means connected to said reservoir sensing means for indicating a low level of toner in said reservoir; and means responsive to an indication from said housing relation sensing means that said housing is not in said window overlying relationship and to said toner reservoir low level indicating means for preventing operation of said copier.

11. In an electrophotographic machine having a plurality of electrophotographic processing elements including a movable photoconductor, a developer, and photoconductor charging and discharging, and further including a plurality of interface element suitable for receiving and transmitting information, the improvement comprising:

a first data processing unit controlling the electrophotographic elements and receiving data signals indicating the status of at least one of said elements; and a second data processing unit for exchanging information with the plurality of interface elements and said first data processing unit and including:

(i) means generating commands for actuating said first data processing unit to operate the electrophotographic elements; and (ii) means receiving said first data processing unit data signals for determining whether the electrophotographic units are operating properly as compared to predetermined standards.

* * * * *